United States Patent [19]

Goodman et al.

[11] Patent Number: 4,841,105

[45] Date of Patent: Jun. 20, 1989

[54] SLIDE SWITCH CONFIGURED AS AN INTEGRATED CIRCUIT PACKAGE

[75] Inventors: Joseph R. Goodman, Walkertown; Roger L. Thrush, Clemmons, both of N.C.

[73] Assignee: AMP Incorporated, Harrisburg, Pa.

[21] Appl. No.: 179,603

[22] Filed: Apr. 11, 1988

[51] Int. Cl.[4] ..... H01H 15/00

[52] U.S. Cl. ..... 200/16 D

[58] Field of Search ..... 200/5 R, 6 R, 6 B, 11 E, 200/11 EA, 11 K, 16 R, 16 C, 16 D

[56] References Cited

U.S. PATENT DOCUMENTS

| | | | |
|---|---|---|---|
| 3,499,126 | 3/1970 | Jones et al. | 200/16 R |
| 4,012,608 | 3/1977 | Lockard | 200/16 D |
| 4,029,917 | 6/1977 | Webster | 200/16 D X |
| 4,168,404 | 9/1979 | Lockard | 200/16 D X |
| 4,376,234 | 3/1983 | Liataud et al. | 200/16 R |
| 4,454,391 | 6/1984 | Olsson | 200/16 R X |
| 4,628,166 | 12/1986 | Bingo et al. | 200/302.1 |
| 4,704,503 | 11/1987 | Takasawa | 200/16 B |
| 4,749,827 | 6/1988 | Wagatsuma et al. | 200/16 D |

FOREIGN PATENT DOCUMENTS 1490780 11/1977 United Kingdom .

OTHER PUBLICATIONS

"Machine Applied PCB Slide Switch", AMP, Inc.; May 11,1982.

*Primary Examiner*—J. R. Scott

*Attorney, Agent, or Firm*—Eric J. Groen

[57] ABSTRACT

A printed circuit board mountable switch includes a insulative body having a plurality of leads extending out of the body, the leads being formed into two parallel and opposed rows with fixed ends of the leads being spaced apart and facing each other on the floor of the body. A slide switch element includes a bow shaped element having first and second contact elements adjacent to respective first and second fixed ends of the leads. The switch element is moveable between a first position where the switch element bridges between the associated first and second lead fixed ends, to a position where the second contact portion only, is in contact with the second fixed end of the lead. The housing body including integrally molded ramps or cams which flank the width of the first and second fixed ends and at least partially extend therebetween. The slide switch element includes at the first contact end, a T-shaped shunt element which includes tabs complementary with the two ramps, such that upon sliding movement of the slide element, the first contact end is lifted vertically off of the floor of the housing.

10 Claims, 9 Drawing Sheets

SLIDE SWITCH CONFIGURED AS AN INTEGRATED CIRCUIT PACKAGE

BACKGROUND OF THE INVENTION

1. Field of the Invention

The subject invention relates to switch for mounting to a printed circuit board which is configured as a dual inline package.

2. Description of the Prior Art

Switches configured as dual inline packages (DIP switches) are utilized within electronic equipment to change the configuration of the equipment. For example, DIP switches are typically found on items such as mother boards within computers or on expansion cards or auxiliary cards which mount within the computer. The switches allow easy changes in configuration in the system, for example, the configuration of a system can be varied to change the output location or printer or plotter model by merely changing the switch settings.

The DIP switches can either be installed and soldered directly to the printed circuit board or the switch can be inserted within a DIP socket similar to that shown in U.S. Pat. No. 4,060,296 to Kunkle, et al. which is soldered to the board. This latter practice enables a faulty switch to be replaced without the complexity of unsoldering the switch from the board.

Such a switch is shown in U.S. Pat. No. 4,454,391 to Olsson where the switch includes a plurality of leads extending outwardly from the body for interconnection to the printed circuit board. The fixed ends of the leads which extend into the housing are spaced apart a sufficient distance to prevent shorting there between. A spring metal slide is located between the two lead fixed ends and is moveable towards and away from, one of the lead fixed ends to connect and disconnect the two opposed leads.

One drawback to this switch design is that the spring metal slide switch is repetitively moved over the plastic floor surface during the activations and deactivations. This movement of the switching element over the plastic material can, over a period of time, cause a plastic film buildup on the underside of the switching element which can insulate the slide switch from its associated lead contact member, even when the slide member is in the activated position. Furthermore, when the slide switch element is left in the deactivated position for a period of time, the contact portion which rests upon the plastic material of the floor can draw moisture from the plastic material, causing corrosion, or the contact portion can pick up dirt from the plastic material causing related discontinuities.

SUMMARY OF THE INVENTION

It is therefore an object of the instant invention to design a slide switch which prevents such a buildup up the plastic material on the contacting surface of the slide switch.

It is further an object of the instant invention to move the slide element to a position remote from the plastic material during the deactivated position.

The above mentioned objects were accomplished by desigining a switch mechanism which includes a housing body comprised of an insulating material, the housing having a floor, and side walls and end walls which upstand from the floor. A plurality of leads extend through the sidewalls of the body, and the leads are arranged in first and second opposed rows with fixed ends of the leads being in a spaced apart and facing relation and disposed in a generally horizontal plane adjacent to the floor of the housing body.

A slide switch element is positioned adjacent to each pair of opposed fixed ends and are moveable between a first position where two opposed fixed ends are commoned by the element bridging between the first and second fixed ends, and to a second position where the slide contacts only the second said fixed end, thereby breaking the continuity between the first and second fixed ends. Camming means are included within the housing body proximate to each of the first said fixed ends of the leads, while follower means, as part of the slide switch element, cooperate with the camming means to lift the slide switch elements vertically off the floor of the package body.

In the preferred embodiment of the invention the ramping means includes two ramp elements which extend at least partially between the first and second fixed ends, flanking the widths of the first and second said fixed ends. The switch element includes two integral tabs adjacent to the first contact portion which engage the two ramp elements, the two tabs being laterally spaced beyond the widths of the lead first fixed ends.

DETAILED DESCRIPTION OF THE PREFERRED EMBODIMENT

Figure 1:
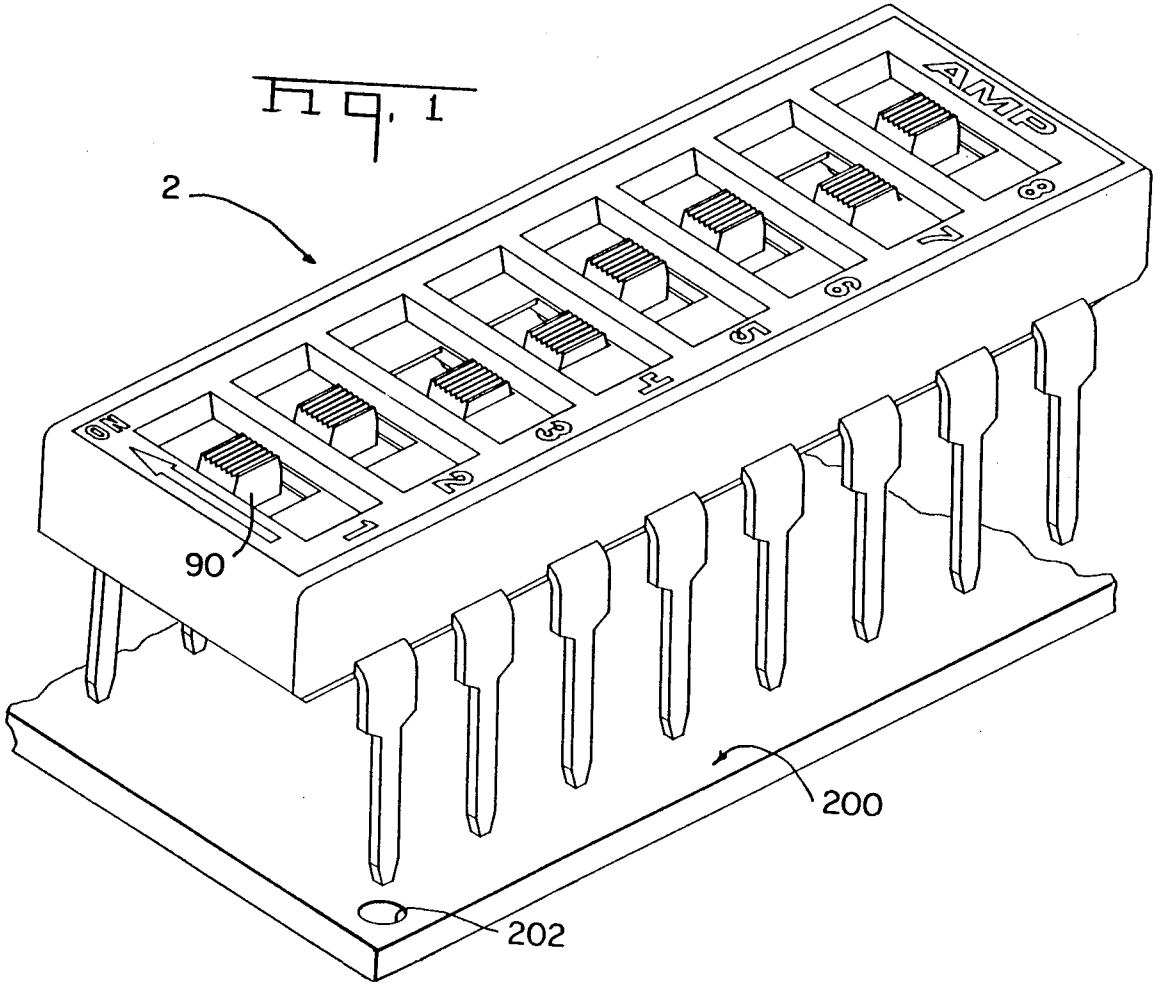
FIG. 1 is an isometric view showing the switch of the instant invention poised above a printed circuit board.
Figure 2:
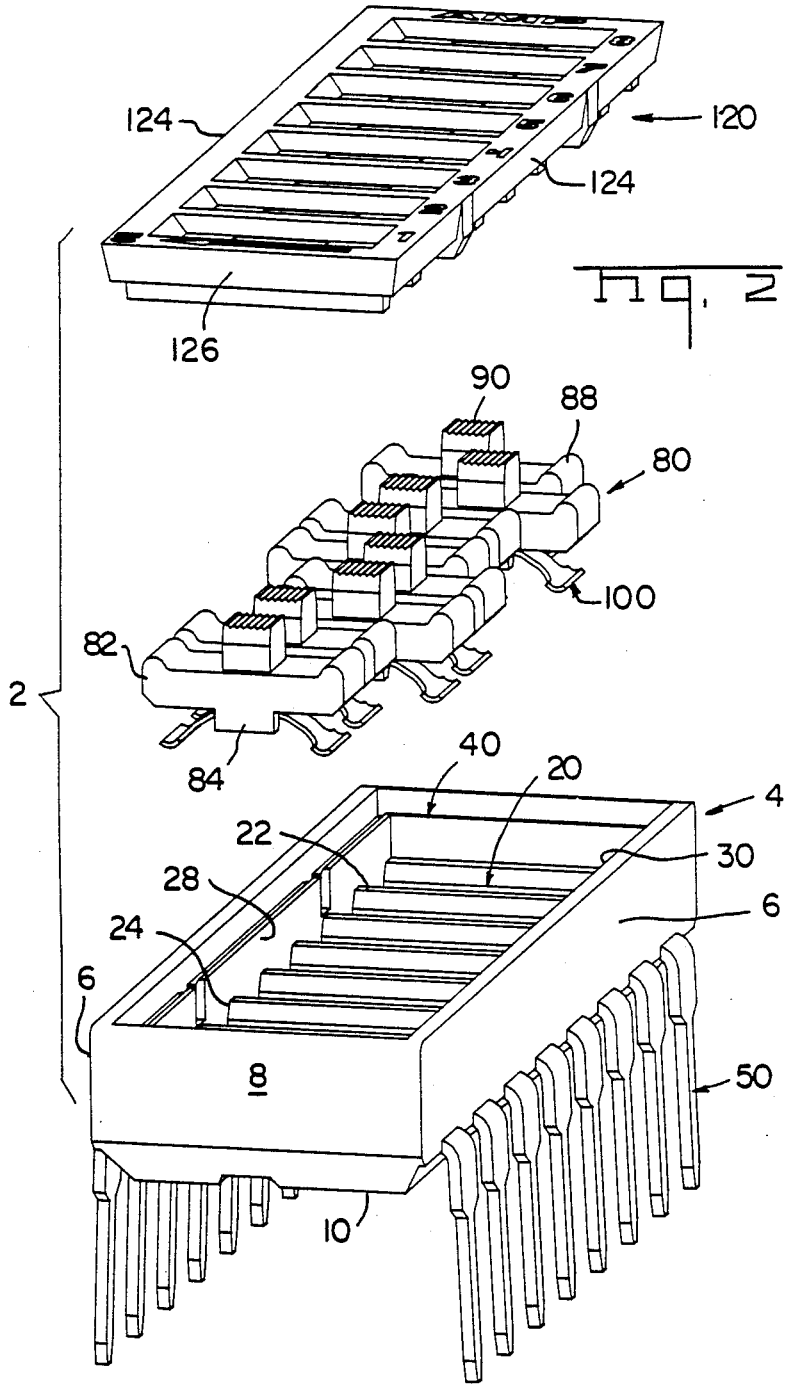
FIG. 2 is an isometric view showing the components of the assembly exploded away from each other.

With reference first to FIG. 1, the subject invention relates to a switch assembly 2 which is interconnectable with a printed circuit board, such as 200, which can be soldered in place and which contains a plurality of slide switch members 90 which can be placed in an activated or in a deactivated condition, thereby switching components into and out of an interconnected relationship on the printed circuit board. Reference to FIG. 2 shows the switch assembly as generally comprising a lower housing body, such as 4, a plurality of switch assemblies 80 and an upper cover, such as 120.

Figure 3:
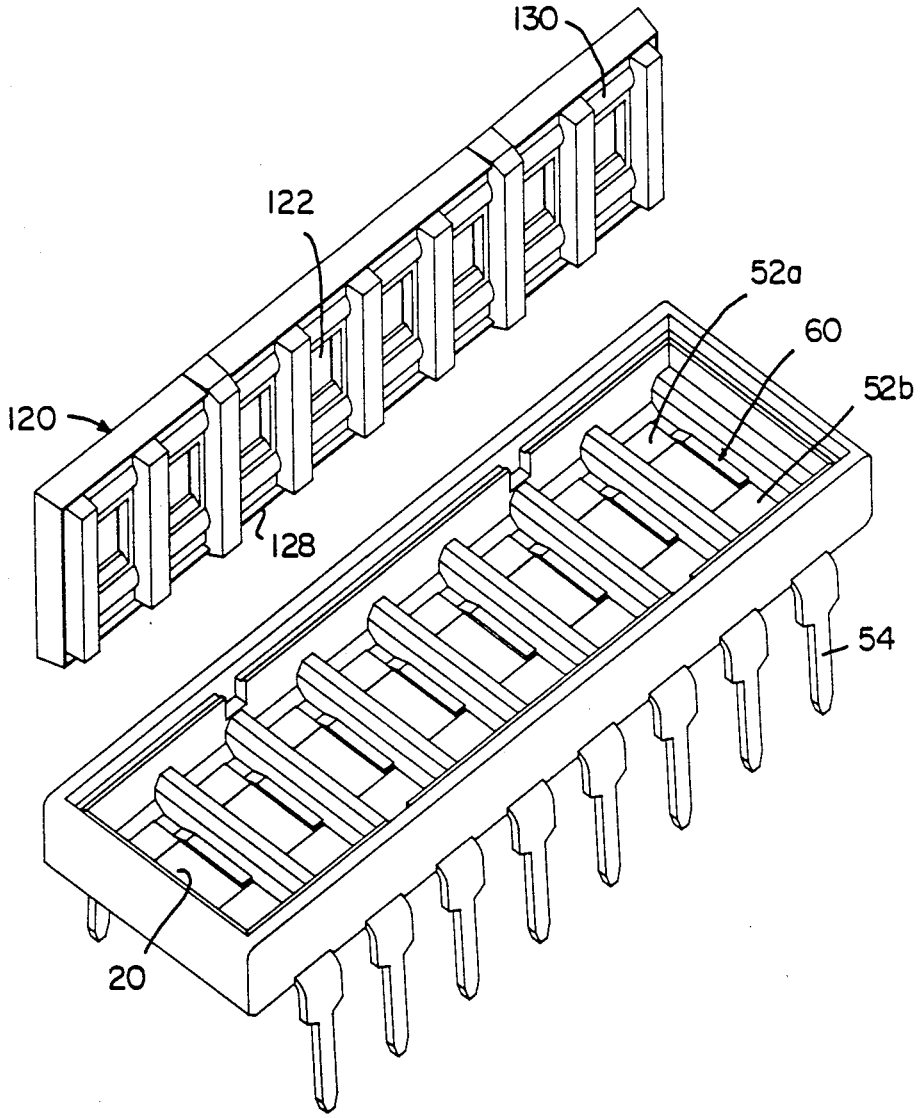
FIG. 3 is an isometric view showing the cover exploded away from the housing body, with the underside of the cover showing.
Figure 4:
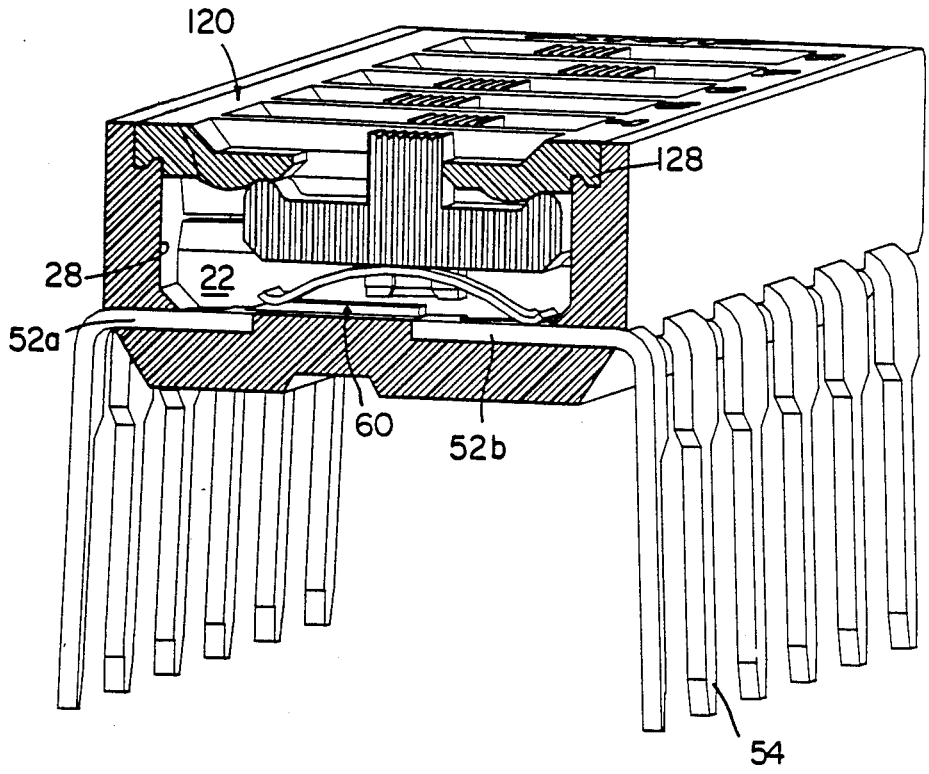
FIG. 4 is an isometric view showing the end of the switch partially cut away to show the inner components as finally assembled, and with the switch in the deactivated condition.
Figure 5:
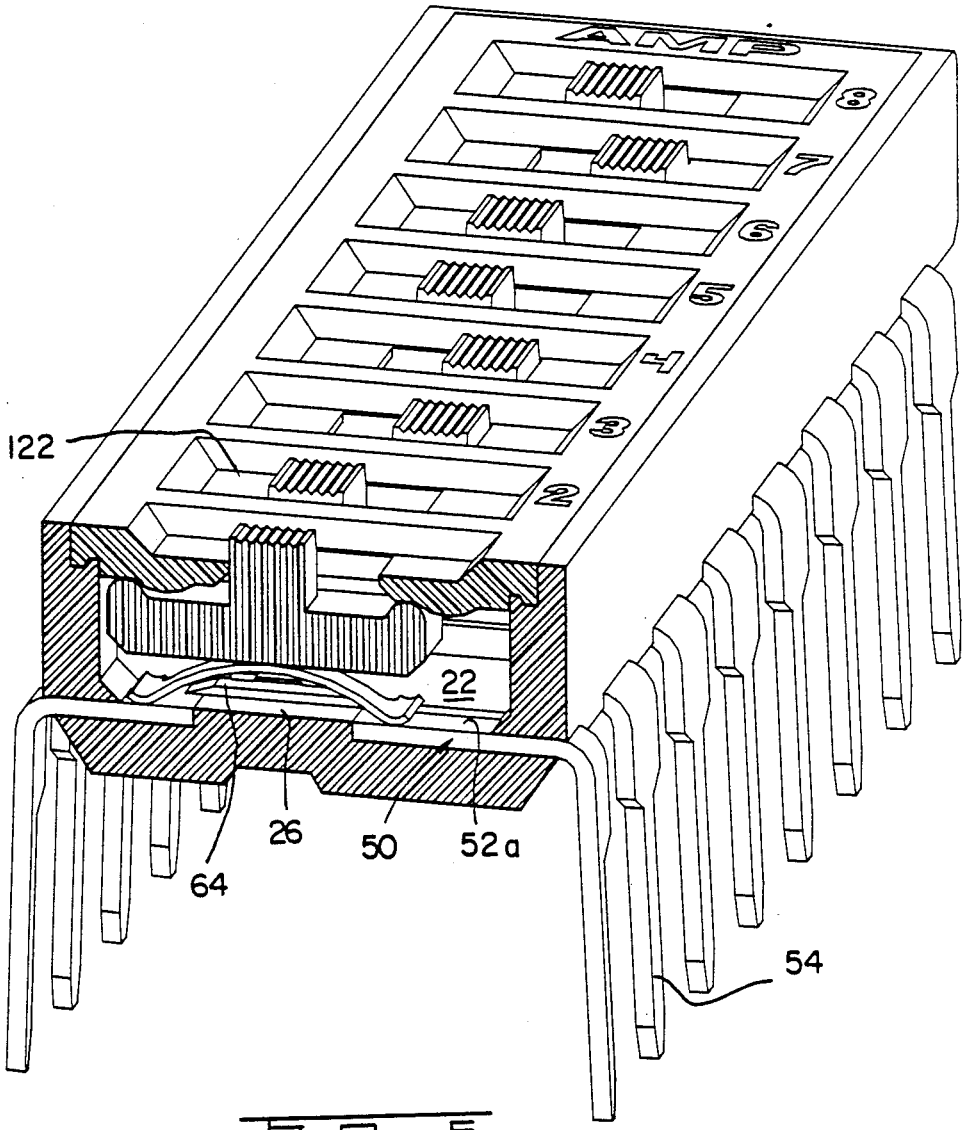
FIG. 5 is an isometric view similar to that of FIG. 4 showing the switch in the activated condition.
Figure 6A:
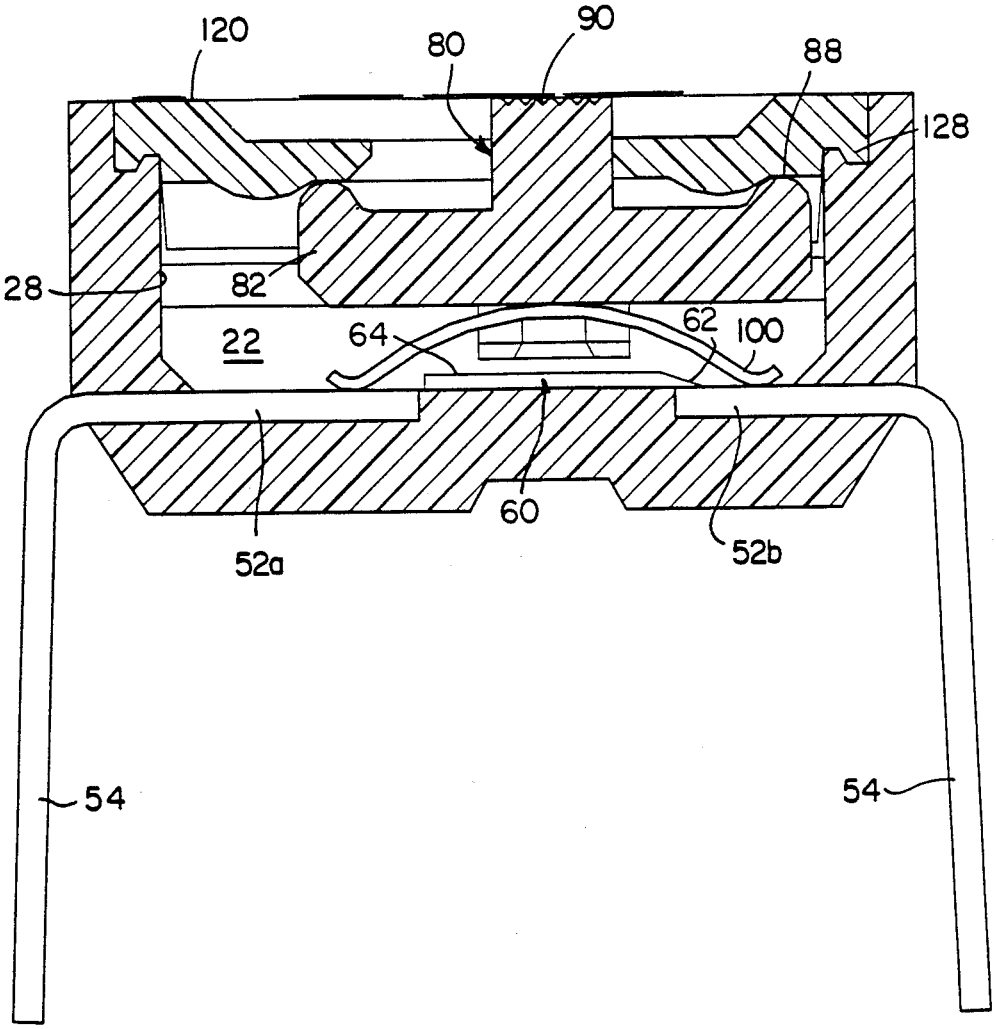
FIG. 6A is a cross-sectional view showing the slide switch in the activated position.
Figure 6B:
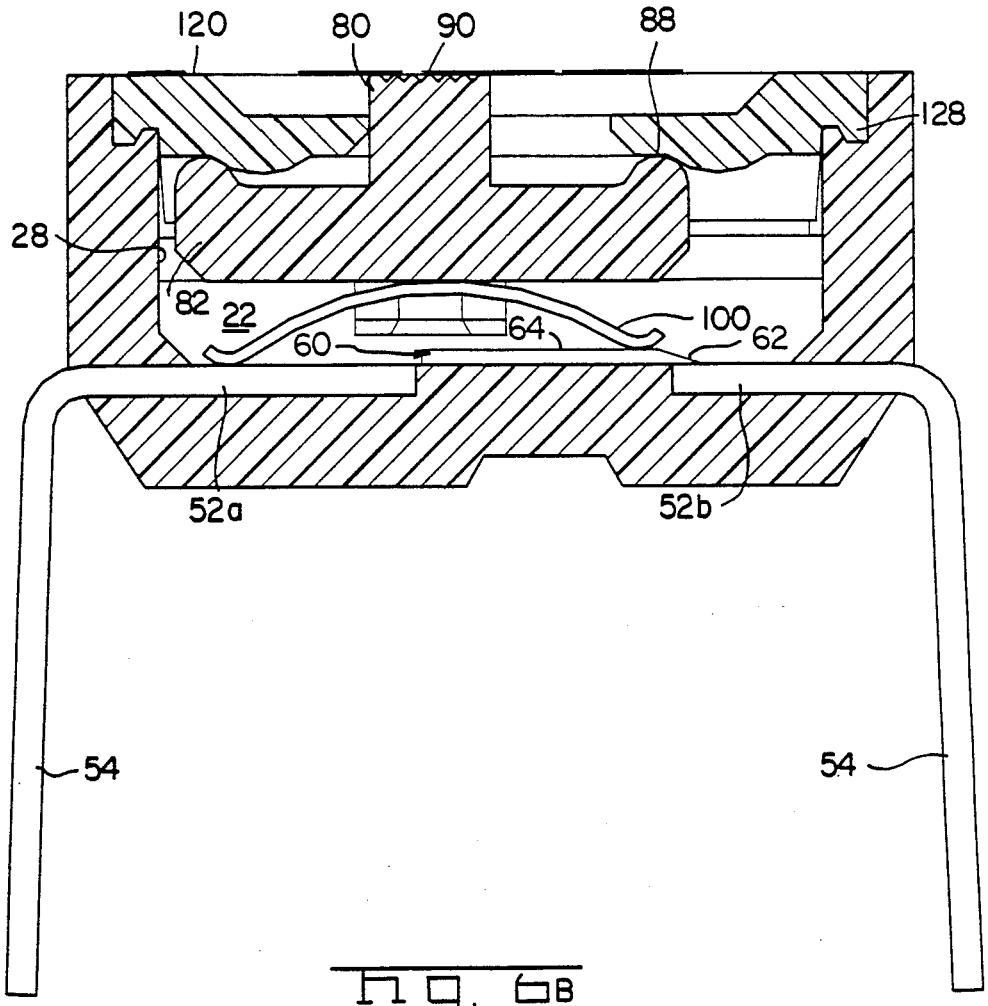
FIG. 6B is the cross-sectional view of FIG. 6A showing the slide switch in the deactivated position.

The lower housing 4 comprises an insulating material having a plurality of lead contacts 50 insert molded therein. The housing 4 generally includes side walls 6 having end walls 8 and a lower surface, such as 10. A plurality of walls, such as 22, define channels or compartments 20 between the walls for receipt of the slide switch members 80, the walls isolating the slide switch members one from the other. The inner surfaces 28, 30 of the side walls 6 include channels, such as 40, which extend around the periphery of the housing body and define a mating surface for the cover 120. As shown in FIGS. 3 and 4, the cover 120 includes a peripheral lip 128 around the edge of the cover 120 which cooperates with the channels.

The lead contacts are also shown in FIGS. 3 and 4 generally as 50 and include fixed ends, such as **52*a* and 52*b*, which are disposed within the channels 20 with a portion of the contacts extending outwardly from the side walls 6 and then bent downwardly into vertical lead portions 54. These vertical lead portions can either be directly interconnected to the printed circuit board through holes 202** or could be interconnected to a dual in-line package (DIP) socket as described above.

Figure 7B:
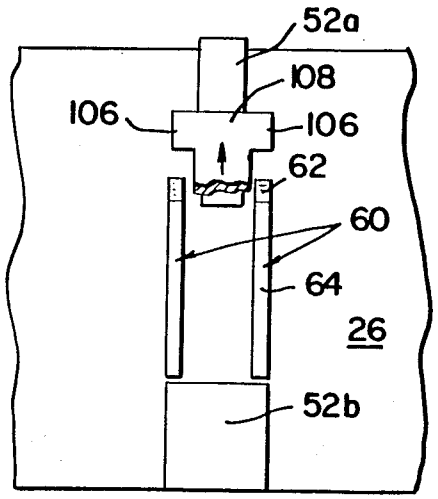
FIG. 7B is a diagrammatical view similar to that of FIG. 7A showing the slide switch in the contacting and activated position.
Figure 7A:
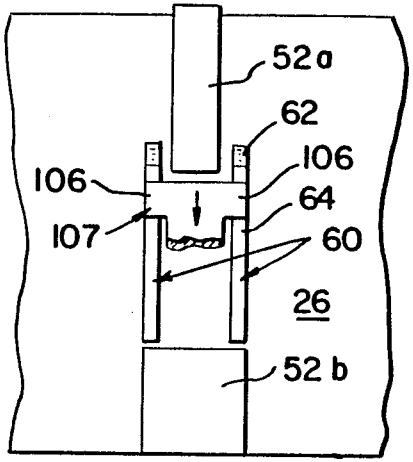
FIG. 7A is a diagrammatical view showing the switch contact in the deactivated position.

FIGS. 7A and 7B depict the internal structure of one of the compartments 20 of the lower housing assembly and show the fixed ends **52*a* and 52*b* being embedded within the floor 26 of the compartment 20. The surface of floor 26 is partially depressed below the surface of the fixed end 52*a* so that the switching contact element 100 does not impinge upon the surface of floor 26. Two lead fixed ends are kept in an isolated manner by a span of plastic material between the two ends of the contacts, the portion of the plastic forming the floor 26 of the compartment. Two cam members are defined as ramps which 60 flank end 52*a* in front of fixed end 52*b* of the contacts 50 and include inclined portions 62 and horizontal portions 64. As shown in FIGS. 7A and 7B, the cam members 60 are spaced to positions laterally beyond the width of the fixed end 52*a* and in front of fixed end 52*b*** of the leads.

Figure 8:
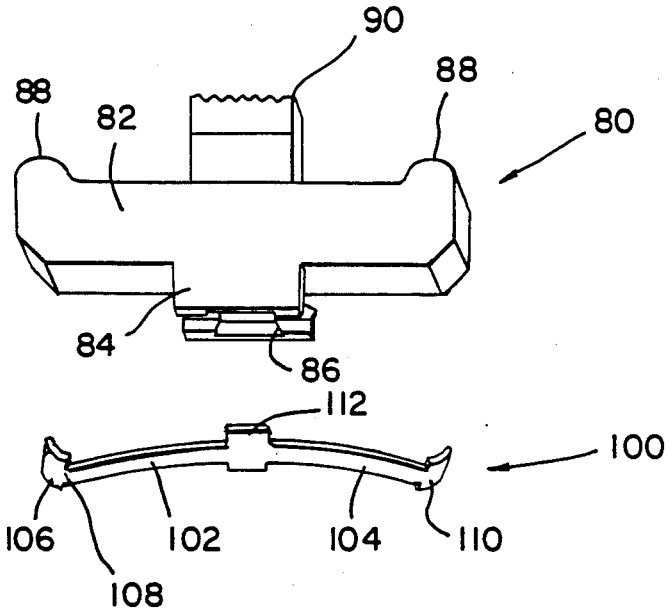
FIG. 8 is an isometric view showing the contact in an exploded manner away from the slide bar.

With reference now to FIG. 8, the slide switch assembly 80 is shown as including a horizontal slide bar 82 which includes two detent members 88 above the horizontal bar 82 with an intermediate switching button 90. Below the horizontal bar member 82 are two extensions or walls, such as 84, which form a channel to accept a retention member 112 of the slide switch element 100. The interior surface of the walls 84 includes a converging surface, such as 86. The switching contact element 100 generally includes two contact arms 102, 104 with contact elements 108, 110 at opposite ends of the arms. The end of contact arm 102 includes a T-shaped follower member 107 having tabs 106, as shown in FIGS. 7A and 7B. The follower member tabs 106 are profiled for mating engagement with the cam members 60.

With reference to FIGS. 2 and 3, the cover portion 120 is shown as including side edges 124 and end edges 126 with a plurality of elongate openings 122 extending through the upper and lower surfaces of the cover member 120. The upper cover 120 includes downwardly facing lips 128 which are profiled for cooperating with the channels 40 of the housing 4.

With reference to FIG. 3 and 4, the under surface of the cover member 120 further comprises a plurality of detent members 130 which are interengageable with the detent members 88 on the slidable switch member 80.

To assemble the subject connector, the contact members 100 are placed within the slide switch members 80 such that the retention features 112 are frictionally fit within the converging surfaces 86. Each of the slide switch assemblies 80 are then inserted within associated channels 20 of the housing 4 and the upper cover 120 is placed over the insulating housing 4. Cover 120 is inserted over the housing 4 such that the lips 128 of the cover 120 are within the channels 40 of insulating housing member 4. The upper cover 120 and the lower insulating housing 4 are retained in position by ultrasonically welding the two members 120 and 4 together, which is the subject of pending U.S. patent application Ser. No. 179,602, filed Apr. 11, 1988.

As assembled, the switch assembly provides an advantage not found in other previous switch designs in that the assembly includes means to lift the spring contact up and away from the portion of the housing floor which is an insulating plastic, thereby preventing the contact from contamination from the plastic. As shown in FIGS. 7A and 7B, as the contact 100 is moved to the deactivated position, the tabs 106 of the follower member 107 engage the ramped portions 62 of the cams or ramps 60 which lifts the contact arm 102 off of the fixed end **52*a* prior to the contact portion 108 sliding over a portion of the plastic insulating material. Similarly, as the contact is moved into the activated position, as shown in FIG. 7B, the tab portions 106 move the contact downwardly such that the contact portion 108 makes contact with the horizontal portion of the fixed end 52*a*. When the slide switch member 80 is in the position shown in FIG. 7B, the fixed ends 52*a* and 52*b* are commoned together, bridged by the spring member 100. It should be noted that the tab portions 106 which contact the cam members 60 are not also making contact with the horizontal contact portion 52*a*, but rather the contact portion 108 is intermediate to the two tab members 106**.

It should be noted that the above described embodiment was shown by way of example, and that various modifications to the above described embodiment are meant to fall within the scope of the invention. For example, the tab members 106 could be located elsewhere along the length of the contact arms with the ramps situated within the housing, positioned appropriately to interengage with the tabs 106. Furthermore, one cam member could be located within the housing, situated intermediate the two fixed ends **52*a* and 52*b* and along the same centerline as the fixed ends 52*a* and 52*b*, and the contact arm, not the contact portion 108, could contact the cam member moving the contact portion 108** away from the floor.

We claim:

1. A switch configured as an integrated circuit package including a housing body comprised of an insulating material with a plurality of leads extending from the body, the leads being arranged in first and second opposed rows with fixed ends of the leads being in a spaced apart and facing relation and disposed in a generally horizontal plane on a floor of the housing body, each pair of opposed fixed ends being in alignment with an associated slide switch element, where each slide switch element comprises a bow shaped element with first and second contact portions at ends of the bow adjacent to respective first and second fixed ends of the leads, each of the slide switch elements being moveable between a first position where two opposed fixed ends are commoned by the first and second contact portions of the respective slide switch element bridging between the first and second fixed ends, to a second position where the contact portions only contact the second said fixed end, thereby breaking the continuity between the first and second fixed ends, the switch being characterized in that:

the housing body includes two ramp elements which extend at least partially between, and flank the widths of, the first and second fixed ends of the leads, and in that each slide switch element includes two integral tabs adjacent to the first contact portion which engage the two ramp elements, which, upon movement of each of the slide switch elements, cause the tabs to slide up the ramp elements, thereby lifting the first contact portions of the slide switch elements vertically away from the floor of the body.

2. The switch of claim 1 characterized in that each ramping element which is integrally molded with the housing body and is located proximate to the first said fixed end.

3. The switch of claim 1 characterized in that the two tabs are laterally spaced beyond the widths of the first fixed ends of the leads.

4. A slide switch configured as an integrated circuit package comprising:

a housing body comprised of an insulating material the housing having a floor, and side walls and end walls which upstand from the floor;

a plurality of leads extending through the sidewalls of the body, the leads being arranged in first and second opposed rows with first and second fixed ends of the leads being in a spaced apart and facing relation and disposed in a generally horizontal plane adjacent to the floor of the housing body;

a slide switch element, generally defined as a bow having first and second contact portions, positioned adjacent to respective first and second opposed fixed ends of the leads, the switch element being moveable between a first position where two opposed fixed ends are commoned by the slide switch element bridging between the first and second fixed ends, and to a second position where the slide switch element contacts only the second said fixed end, thereby breaking the continuity between the first and second fixed ends;

camming means comprising at least one cam member located within the housing body proximate to each of the first said fixed ends of the leads, each cam member upstanding higher than the first fixed end of the lead and having an inclined section at least partially along one side of the first fixed end of the lead; and follower means as part of the first contact portion of the slide switch element which cooperates with the cam member to lift the slide switch element vertically off the floor of the housing body, when the slide switch element is moved from the first to second position.

5. The switch of claim 4 wherein the slide switch element comprises a bow shaped element with first and second contact portions at ends of the bow adjacent to respective first and second fixed ends of the leads.

6. The switch of claim 5 wherein the camming means comprises at least one inclined cam element which is integrally molded with the housing body and is located proximate to the first said fixed end.

7. The switch of claim 6 wherein the camming means includes two cam elements which extend at least partially between the first and second fixed ends.

8. The switch of claim 7 wherein the two cam elements flank the widths of the first and second said fixed ends.

9. The switch of claim 8 wherein the follower means comprises two integral tabs adjacent to the first contact portion which engage the two cam elements.

10. The switch of claim 9 wherein the two tabs are laterally spaced beyond the widths of the lead first fixed ends.

* * * * *